US005402806A

United States Patent [19]

Hakeem et al.

[11] Patent Number: 5,402,806

[45] Date of Patent: Apr. 4, 1995

[54] CLEANING APPARATUS HAVING A PARTITIONED BOIL SUMP

[75] Inventors: Louis E. Hakeem, Tiverton, R.I.; Frank M. Hriadil, Nashua, N.H.

[73] Assignee: Northrop Grumman Corporation, Los Angeles, Calif.

[21] Appl. No.: 140,285

[22] Filed: Oct. 19, 1993

[51] Int. Cl.[6] ..... B08B 3/12

[52] U.S. Cl. ..... 134/60; 134/61; 134/108; 134/111; 134/186

[58] Field of Search ..... 134/60, 61, 105, 107, 134/108, 111, 184, 186

[56] References Cited

U.S. PATENT DOCUMENTS

| | | | |
|---|---|---|---|
| 3,229,702 | 1/1966 | Murdoch, Jr. | 134/60 X |
| 3,923,541 | 12/1975 | Healy | 134/105 X |
| 4,029,517 | 6/1977 | Rand | 134/105 X |
| 4,224,110 | 9/1980 | McCord | 202/169 |
| 4,486,239 | 12/1984 | du Fresne | 134/11 |
| 4,753,735 | 6/1988 | Figiel | 210/664 |
| 4,865,060 | 9/1989 | Shibano | 134/60 |
| 4,886,082 | 12/1989 | Kato et al. | 134/60 |
| 4,895,176 | 1/1990 | Ohtsuka et al. | 134/60 X |
| 4,907,611 | 3/1990 | Shibano | 134/60 |
| 5,067,983 | 11/1991 | Uchino | 134/1 |
| 5,085,238 | 2/1992 | Baldwin | 134/105 |
| 5,113,883 | 5/1992 | Sluga et al. | 134/60 |

FOREIGN PATENT DOCUMENTS

| | | | |
|---|---|---|---|
| 2418681 | 11/1979 | France | 134/107 |
| 565727 | 7/1977 | U.S.S.R. | 134/108 |

*Primary Examiner*—Philip R. Coe

*Attorney, Agent, or Firm*—Terry J. Anderson; Karl J. Hoch, Jr.

[57] ABSTRACT

In a cleaning apparatus, a boil sump containing a cleaning solvent within four sidewalls and a bottom. Additionally, the boil sump has a partition extending between two opposing sidewalls that separates the boil sump into a boiling compartment and a cleaning compartment. Furthermore, the partition contains a conduit therethrough that permits the solvent to flow between the cleaning and boiling compartments. The boiling compartment contains a heater that heats the solvent to a boil while the cleaning compartment contains an ultrasonic transducer array for ultrasonically cleaning an object placed in the cleaning compartment. In addition to the boil sump, the cleaning apparatus contains a rinsing compartment for rinsing an object that has been cleaned in the cleaning compartment. The boil sump, as well as the rinsing compartment, are contained in a single, enclosed chamber within the cleaning apparatus.

28 Claims, 3 Drawing Sheets

CLEANING APPARATUS HAVING A PARTITIONED BOIL SUMP

BACKGROUND OF THE DISCLOSURE

1. Field of the Invention

The invention relates to cleaning apparatus and more particularly, to cleaning apparatus that contains a partitioned boil sump.

2. Description of the Prior Art

Conventional apparatus for cleaning objects, such as piece parts of manufactured goods, circuit boards, screws, bolts, nuts, and the like, typically use a multi-stage cleaning process in which an object is sequentially immersed in a series of chambers or tanks. Typically, these tanks contain a single solvent and, as such, the apparatus is known as a mono-solvent cleaning apparatus. Furthermore, conventional apparatus continuously cleanses the solvent during operation of the apparatus using a distilling process. Such distilling processes use a distinct boil sump to boil the solvent into a vapor and a condenser to condense the vapor into the solvent solution. The boil sump is generally separate from the tanks used for cleaning and rinsing an object.

Conventional solvents used for degreasing and cleaning metal and other non-absorbent objects include 1,1,1-trichloroethane, trichloroethylene, perchloroethylene, methylene chloride and the like. However, these solvents are suspected of depleting the earth's ozone layer. Consequently, so-called "ozone safe" solvents have recently been used in commercial cleaning apparatus. Illustratively, volatile solvents that are ozone safe include perflourocarbons (PFCs) and hydroflourocarbons (HFCs). Additionally, non-volatile, ozone safe solvents include hydrocarbon-based products such as dimethylsiloxane produced by DOW Chemical of Midland, Mich. and AXEREL produced by E. I. duPont de Nemours and Company of Wilmington, Del.

A typical cleaning apparatus using a multi-stage, single solvent cleaning process is disclosed in U.S. Pat. No. 4,886,082 issued Dec. 12, 1989 to S. Kato et al. (the '082 Kato et al. patent). This patent specifically teaches a three stage process by which objects are cleaned in three separate tanks of solvent.

To clean an object in accordance with the teachings of the '082 Kato et al. patent, the object is first placed in a vapor cleaning tank wherein a solvent is heated above its boiling point and the vapor of the solvent cleans the object. The object is not immersed in the solvent itself, but rather is positioned above the boiling liquid solvent.

After vapor cleaning for a pre-defined duration, the object is moved from the vapor cleaning tank to an ultrasonic cleaning tank. The vapor cleaning tank and the ultrasonic cleaning tank contain the same solvent. The object is immersed in the liquid solvent contained in the ultrasonic cleaning tank and ultrasonic transducers located at the bottom of the tank apply ultrasonic waves to the solvent. As is well known in the art, ultrasonic cavitation of the solution caused by the ultrasonic waves removes particulate material from the object.

Lastly, the cleaning process taught by the '082 Kato et al. patent teaches immersing the object into a liquid solvent in a rinse tank. The solvent contained in the rinse tank is the same solvent as that used in the vapor cleaning and ultrasonic cleaning tanks. The object, now that it is clean, is then removed from the cleaning apparatus and air dried.

To continuously cleanse the solvent while it is used in the cleaning apparatus, the '082 Kato et al. patent teaches continuously removing a portion of the solvent from the vapor cleaning tank and channeling the removed solvent to a separate distilling tank, also known in the art as a boil sump. In the distilling tank, the solvent is heated to a boil to produce solvent vapor. A condenser, located above the distilling tank and maintained at a temperature substantially below the boiling point of the solvent, condenses the solvent vapor into a solution. The solvent solution is channeled from the condenser into the rinse tank. The rinse tank is separated from the ultrasonic tank by a spillway that enables the solvent from the rinse tank to overflow into the ultrasonic cleaning tank. A conduit connects the ultrasonic tank to the vapor cleaning tank to provide solvent thereto. Lastly, the vapor cleaning tank is connected, via a conduit, to the distilling tank. As such, a closed system is produced that requires the solvent to sequentially circulate through each of the tanks and ultimately be boiled in the distilling tank before recirculation. Therefore, particulate contaminants, grease and oil contained in the solvent solution are continuously removed from the solvent by the distilling process and those contaminants remain in the distilling tank.

The '082 Kato et al. patent teaches using a distinct distilling tank that is separate from the cleaning and rinsing tanks. To reduce the footprint of the cleaning apparatus and, also, simplify the overall design thereof, it would be advantageous to have a single tank that can be used for both ultrasonic cleaning of objects and distilling the solvent, i.e., an integrated cleaning and distilling tank.

Furthermore, in cleaning some objects, a single solvent is not sufficient and two different solvents, i.e., co-solvent cleaning, must be used to facilitate complete cleansing of the object. For example, some types of grease and oils are best removed by a non-volatile hydrocarbon-based solvent. However, such non-volatile solvents do not dry very quickly and may not remove all forms of contaminants from the object. Moreover, when air dried, a non-volatile solvent may leave a solid residue on the object. Therefore, a second solvent, typically a volatile solvent, is used to remove the residual non-volatile solvent from the object and also remove any remaining oils, greases or particulate matter not removed from the object by the non-volatile solvent. Advantageously, volatile solvents dry by evaporation in a relatively short period of time. Thus, a co-solvent cleaning process removes a variety of particulate matter, grease and oil from an object as well as produce a dry object within a relatively short period of time. Thus, it would be also advantageous to have a cleaning apparatus that is capable of both mono-solvent and co-solvent cleaning operations.

Therefore, a need exists in the art for a single cleaning apparatus having a distilling tank that is an integral portion of the cleaning tank and that performs both mono-solvent and co-solvent cleaning.

SUMMARY OF THE INVENTION

Our invention advantageously overcomes the disadvantages heretofore associated with cleaning apparatus. Specifically, our invention contains a single boil sump that is partitioned into a boiling compartment and a cleaning compartment, i.e., contains integrated distilling and cleaning compartments. Furthermore, through our invention, either one solvent (mono-solvent operation) or two solvents (co-solvent operation) can be used in a single cleaning apparatus. In mono-solvent operation, one solvent is used for both cleaning and rinsing of an objection. In co-solvent operation, an object is first cleaned in a first solvent, then rinsed in a second solvent to remove residual first solvent from the object. To facilitate optimal cleaning, ultrasonic cleaning techniques are used during both cleaning and rinsing of the object. Additionally, to maintain a clean solvent in mono-solvent operation or a clean second (rinsing) solvent in co-solvent operation, the solvent is continuously cleaned using a distilling process.

More specifically, our inventive cleaning apparatus contains a single chamber having two portions. The two portions are a boil sump and a rinsing compartment. The boil sump is adjacent the rinsing compartment and separated therefrom by a first wall portion. The boil sump is partitioned by a second wall portion into a boiling compartment and a cleaning compartment. The second wall portion contains at least one conduit therethrough connecting the cleaning compartment to the boiling compartment.

During co-solvent operation, the second solvent is contained in both the boiling and cleaning compartments and flows through the conduit therebetween. The first solvent, having a density that is less than the density of the second solvent and a boiling point that is higher than the boiling point of the second solvent, is also contained in both the boiling and cleaning compartments. Consequently, the first solvent floats above the second solvent and has a level that exceeds a height of the second wall portion separating the boiling and cleaning compartments. Thus, both the first and second solvents flow between the boiling and cleaning compartments within the boil sump.

A heater, typically an electric heating element, is located in the boiling compartment in contact with the second solvent. The heater increases the temperature of the second solvent above its boiling point to produce a second solvent vapor. Furthermore, the heater temperature is controlled such that the temperature of the second solvent remains below the boiling point of the first solvent. Thus, only second solvent vapor is produced. As such, the second solvent vapor rises through the first solvent and into a vapor space above the compartments. The vapor space has a bottom defined by the compartments, four sides defined by four sidewalls of the apparatus, and a top defined by a vapor barrier. The vapor barrier is produced by a condenser that surrounds an opening to the chamber and cools the vapor in the opening below its boiling point to produce condensed second solvent vapor, i.e., the condenser reproduces the second solvent. A trough, connected to the condenser and also surrounding the opening to the chamber, channels the condensed second solvent into a water separator that removes water from the second solvent. Once the water is removed, a conduit carries the second solvent into the rinsing compartment. Once filled, the solvent in the rinsing compartment cascades over the first wall portion into the cleaning compartment of the boil sump. The second solvent then flows back into the boiling compartment via the conduit between the cleaning and boiling compartments. In this manner, the apparatus provides a closed distillation process that cleanses the second solvent. Consequently, the second solvent is continuously distilled to produce clean second solvent for the rinsing compartment and contaminants are collected in the boiling compartment.

In operation, to clean an object using two solvents, the object is first immersed into the first solvent contained in the cleaning compartment and is thereafter rinsed by immersing the object into the second solvent contained in the rinsing compartment. Typically, the first solvent is a non-volatile solvent. As such, the solvent will not dry quickly after the object is removed from the cleaning compartment. Additionally, non-volatile solvents may leave unwanted residue on the object after drying. To alleviate these problems, the second solvent is typically a volatile solvent that removes any residue of the first solvent from the object. After a pre-defined duration, the object is removed from the second solvent and allowed to dry. Since the first solvent is volatile, the drying time is relatively short.

To facilitate improved cleaning of the object, an array of ultrasonic transducers is located at the bottom of both the cleaning and rinsing compartments. By generating ultrasonic cavitation within the solvents, the object is cleaned to a greater extent than without using ultrasonic cleaning.

During mono-solvent operation, the first solvent is not used and the second solvent, typically a volatile solvent, is used to clean as well as rinse the object.

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

Our cleaning apparatus performs a multi-step cleaning process using either one or two solvents. To facilitate understanding of our invention, first the apparatus is described as used with two solvents (co-solvent operation); then we describe the apparatus as used with one solvent (mono-solvent operation).

Figure 1:
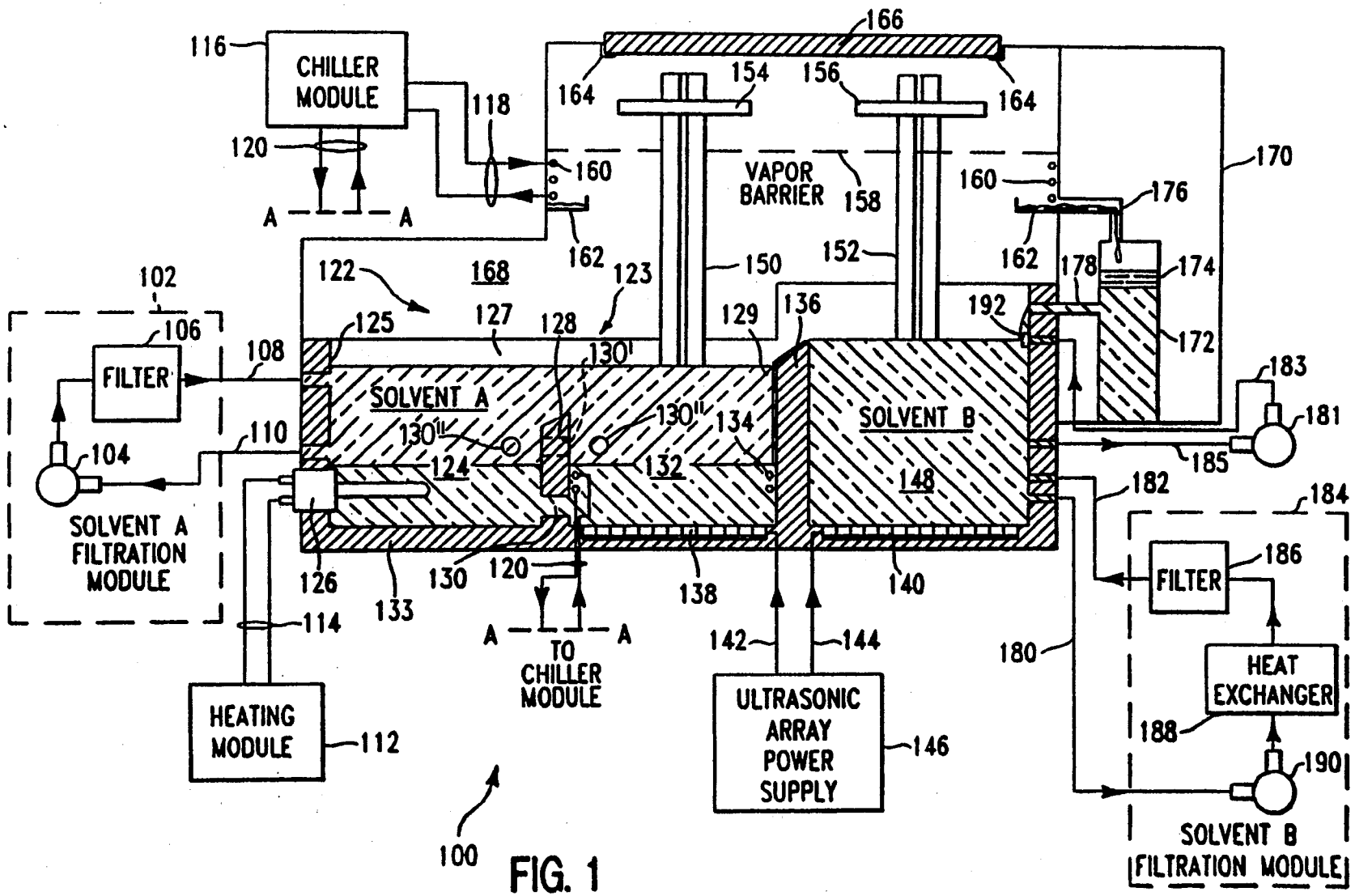
FIG. 1 shows a section view of our inventive cleaning apparatus during co-solvent operation.
Figure 2:
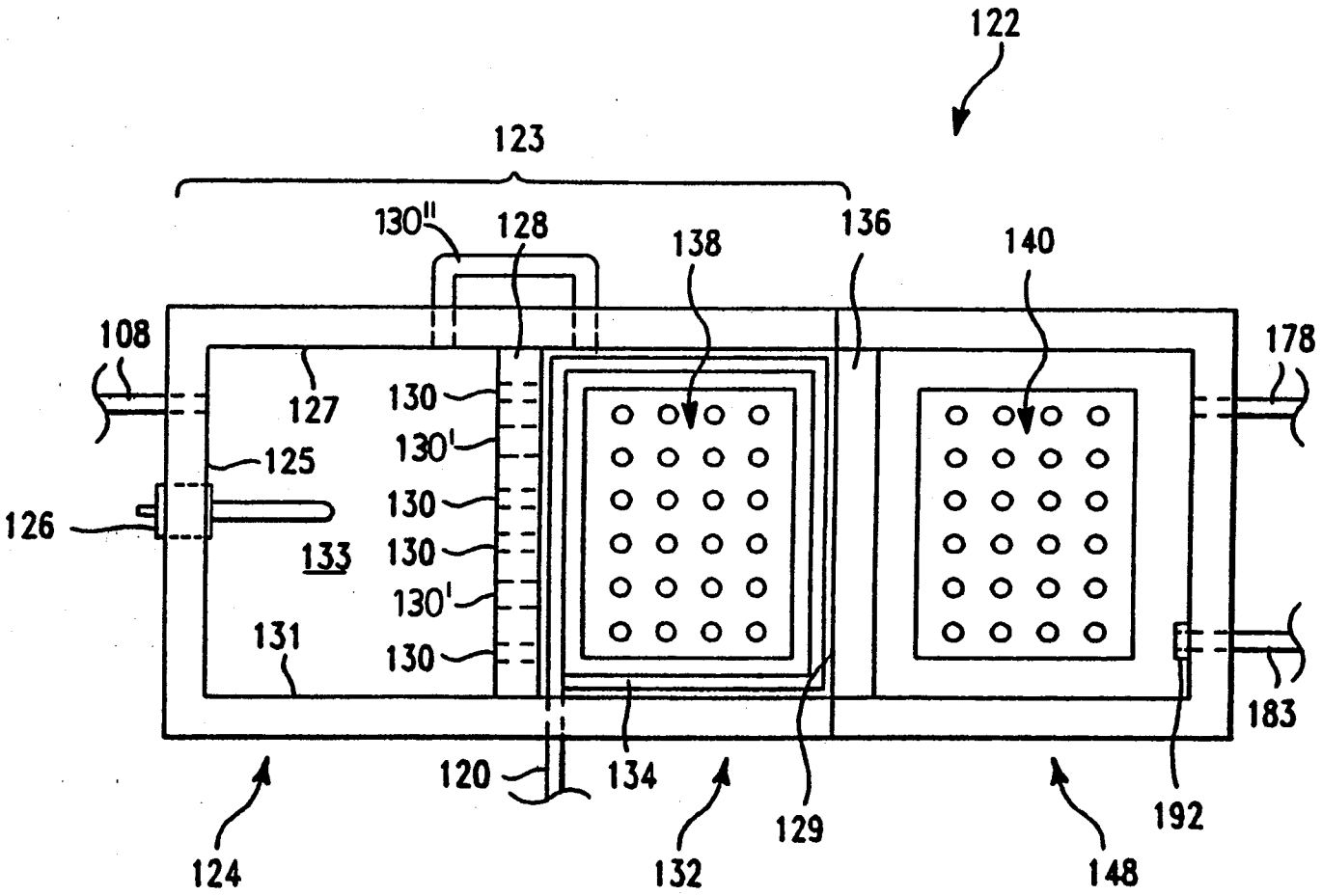
FIG. 2 shows a top plan view of chamber 122 of the cleaning apparatus shown in FIG. 1.

FIG. 1 shows a section view of our inventive cleaning apparatus during co-solvent operation; while FIG. 2 depicts a top plan view of chamber 122 within apparatus 100 shown in FIG. 1. To best understand the implementation and operation of the cleaning apparatus during co-solvent operation, the reader should simultaneously consult both FIGS. 1 and 2.

The entire cleaning process is accomplished by apparatus and solvents contained within a single, enclosed chamber. During co-solvent operation of the apparatus, one solvent is used in a cleaning step of the cleaning process and another solvent is used in a rinsing step. Additionally, using a distilling process, the cleaning apparatus continuously cleans the solvent used in the rinsing step. Furthermore, to optimize the cleaning process, the apparatus uses an ultrasonic cleaning technique during both the cleaning and rinsing steps.

Specifically, cleaning apparatus 100 contains chamber 122, solvent A filtration module 102, solvent B filtration module 184, chiller module 116 and heating module 112. Chamber 122 contains two portions; boil sump 123 and rinsing compartment 148. The boil sump is further partitioned into boiling compartment 124 and cleaning compartment 132. In operation, cleaning compartment 132 performs object cleaning using solvent A, rinsing compartment 148 performs object rinsing using solvent B, and boiling compartment 124 facilitates continuously cleansing solvent B during operation of the apparatus. Moreover, compartments 132 and 148, respectively, contain ultrasonic transducer arrays 138 and 140. Leads 142 and 144 connect each ultrasonic array to ultrasonic array power supply 146. Additionally, boiling compartment 124 contains heating element 126 connected, via leads 114, to heating module 112 such that solvent B is heated to a boil. Proximate to the top of the chamber and surrounding an opening therein are a plurality of condensing coils 160 that are supplied with a refrigerant by chiller module 116. These coils produce a vapor barrier that confines solvent B vapor to the chamber. As such, condensing coils 160 condense the solvent B vapor and, subsequently, trough 162 channels the condensed vapor into water separator 172. Solvent B is then reintroduced into chamber 122 via conduit 178 connecting water separator 172 to rinsing compartment 148.

Although non-ozone safe solvents can be used in our inventive cleaning apparatus, current industry trends suggest such solvents will be replaced with ozone safe solvents. In view of this trend, our inventive apparatus is described using ozone safe solvents. Specifically, the cleaning solvent (solvent A) is typically a non-volatile solvent such as a hydrocarbon-based solvent and the rinsing solvent (solvent B) is typically a volatile solvent such as a perflourocarbon solvent. Generally speaking, the two solvents are not miscible. For example, solvent A is AXEREL-9000 and solvent B is VERTREL 245 both manufactured by E. I. duPont de Nemours of Wilmington, Del. Alternatively, the hydrocarbon-based, non-volatile solvent could be a dimethylsiloxane such as OS-30 produced by DOW Chemical of Midland, Mich. and the perflourocarbon could be PF-5070 produced by Minnesota Mining and Manufacturing (3M) Industrial Chemical Products Division of St. Paul, Minn. Generally speaking, these solvents are manufactured in a variety of forms that have various boiling points and vapor pressures. Those skilled in the art would be able to select an appropriate solvent for cleaning a specific object. For the remainder of this discussion, it is assumed that the apparatus is using PF-5070 as the rinsing solvent (solvent B) and AXEREL-9000 as the cleaning solvent (solvent A). Empirical studies have shown that the PF-5070 is only 2% miscible with AXEREL-9000. As such, the two solvents remain separate when contained in the boil sump such that AXEREL-9000, being lighter than PF-5070, floats above the PF-5070.

More specifically, boil sump 123 contains four sidewalls 125, 127, 129, 131 and bottom 133. Within boil sump 123, boiling compartment 124 is adjacent to and separated from cleaning compartment 132 by wall portion 128 that connects sidewall 127 to sidewall 131. Additionally, boil sump 123 is adjacent to and separated from rinsing compartment 148 by wall portion 136. To clearly identify the two wall portions, hereinafter wall portion 136 is referred to as the first wall portion and wall portion 128 is referred to as the second wall portion.

Second wall portion 128 contains conduit 130 that connects compartments 124 and 132. Conduit 130 is located below the fluid level of solvent B such that the solvent flows through the conduit from the cleaning compartment to the boiling compartment. As such, the fluid level of solvent B is equal in both compartments of the boil sump.

The boiling compartment contains heater 126 that is connected, via leads 114, to heater module 112. The heater module supplies a controlled electric current to the heating element of the heater. The heater increases the temperature of solvent B above its boiling point, i.e., above 173 degrees F. for PF-5070, but not above the boiling point of solvent A, i.e., not greater than 200 degrees F. for AXEREL-9000. Consequently, solvent B boils into a vapor that passes through solvent A and into chamber 122. The vapor is contained within vapor space 168 by the sidewalls of apparatus 100, by the surface of the solvent A in the boil sump and solvent B in the rinse compartment, and by vapor barrier 158.

Vapor barrier 158 is established by refrigeration coils 160 which surround an opening into chamber 122. Chiller module 116 provides refrigerant, via conduits 118, to coils 160 such that the air at the vapor barrier is cooled to approximately −20 degrees F. Consequently, at the vapor barrier, solvent B vapor condenses upon refrigeration coils 160. Trough 162 is located below the coils and also surrounds the opening into chamber 122. The condensed vapor from the coils drips into trough 162 and conduit 176 channels the liquid into water separator 172 located in housing 170. The water separator is a holding tank wherein water (indicated by reference number 174) separates from the condensed solvent B vapor. For example, since PF-5070 has a density of 1.73 gm/cc, water, having a density of 1 gm/cc, floats on the PF-5070. Consequently, PF-5070 can be easily separated from water. Solvent B is removed from the water separator via conduit 178 and reintroduced into rinsing compartment 148 within chamber 122. Using the boiling-condensing process described above, i.e., a distilling process, any particulate contaminants contained in solvent B accumulate in the boiling compartment of the boil sump. Thus, relatively clean solvent B is continuously introduced into the rinsing compartment.

The introduction of solvent B into the rinsing compartment raises the fluid level within this compartment. As the level of solvent B rises above first wall portion 136, solvent B cascades over the wall portion into cleaning compartment 132 of boil sump 123. In this compartment, solvent B sinks below solvent A. Subsequently, as solvent B is boiled into a vapor within boiling compartment 124, solvent B flows through conduit 130 into boiling compartment 124. From this compartment, the distilling process continuously cleans solvent B and reintroduces the solvent into the rinsing compartment.

Additionally, to further cleanse solvent B, filtration module 184 is provided. This module contains pump 190, filter 186 and heat exchanger 188. The pump continuously circulates solvent B from the rinsing compartment via conduit 180, through the filter, and back to the rinsing compartment via conduit 182. In series with the filter and pump is heat exchanger 188. The heat exchanger maintains the temperature of solvent B in the rinsing compartment well below its boiling point. For example, the temperature of PF-5070 when used as solvent B is maintained at approximately 150 degrees F. Additionally, the continuous circulation of the solvent minimizes possible temperature gradients within the rinsing solvent. Any such temperature gradients would detrimentally impact the ultrasonic cavitation within the solvent.

Additionally, to ensure that the oils, greases, and residual solvent A flow over first wall portion 136, pump 181 generates a current across the surface of solvent B. Pump 181 intermittently removes solvent from the rinsing compartment via conduit 185. Specifically, the pump is activated after an object has been removed from the rinsing compartment, i.e., whenever contaminants are floating in the rinsing compartment. When activated, pump 181 transfers the removed solvent back to the rinsing compartment via conduit 183. Sparge 192 connects conduit 183 to rinsing compartment 148. The sparge is located in the wall of the compartment at the highest level of solvent such that, as fluid exits the sparge, it produces a current across the surface of the solvent. As such, oils, greases, and residual solvent A that float on the surface of solvent B are urged to flow over first wall portion 136. Thus, solvent B in the rinsing compartment remains relatively free of contaminants.

Solvent A is contained in both the boiling compartment and the cleaning compartment. Solvent A is provided at such a fluid level that it freely flows between the two chambers over second wall portion 128. Typically, enough solvent A is contained in the two compartments to absorb oil and particulate matter produced while cleaning an object in solvent A. Alternatively, the level of solvent A can be maintained below the height of the second wall portion and the two compartments connected to one another by one or more conduits 130' or 130". Such a conduit connection can be produced either through the second wall portion or around the wall portion using plumbing.

Filtration module 102 provides cleansing for solvent A. Module 102 contains filter 105 and pump 104 connected to the boiling chamber by conduits 108 and 110. The pump continuously circulates solvent A through the filter such that the filter removes particulate matter from the solvent.

Ultrasonic arrays 138 and 140 are "off-the-shelf" components. Illustratively, model VIBRA-BAR manufactured by Crest Ultrasonics Corporation of Trenton, N.J. is an appropriate array for use in both chambers. Additionally, illustrative power supplies also manufactured by Crest Ultrasonics Corporation include models 4G-250-3-WSA and 4G-500-6-WSA. Use of such arrays and their associated power supplies is old in the art and needs no further explanation to understand the operation of the invention.

The close proximity of the boiling compartment to the cleaning compartment and the conduit connection between these two compartments could cause the temperature of solvent B in the cleaning compartment to exceed its boiling point. Such boiling would produce excessive turbulence within solvent A in the cleaning compartment and detrimentally impact ultrasonic cavitation therein. Therefore, solvent B within the cleaning compartment is maintained at a temperature below its boiling point. To this end, refrigeration coils 134 are provided within cleaning compartment 132. The coils are supplied refrigerant from chiller module 116 along conduits 120. These coils directly contact solvent B and maintain the temperature thereof significantly below the solvent B boiling point, e.g., at approximately 150 degrees F. for PF-5070. As such, boil sump 123 contains heated solvent in boiling compartment 124 and a cooled solvent in cleaning compartment 132.

In operation, an operator of the apparatus slides, on door guides 164, door 166 into an open position and places an object upon lift basket 154. Thereafter, the operator closes door 166 that initiates a cleaning cycle. The lift basket is then mechanically lowered along rail 150 into cleaning compartment 132 such that the object is immersed in solvent A, but does not become immersed in solvent B. Once immersed, power is supplied to ultrasonic array 138. Consequently, solvent A in combination with ultrasonic cavitation removes particulate matter, grease, and oils from the object.

Alternatively, the operator can lower a basket containing the object into the cleaning compartment by hand. The specific use of a mechanically operated lift basket is only shown as an illustrative manner in which to implement the cleaning process.

After a pre-defined duration, power to ultrasonic array 138 is discontinued and the lift basket is slowly raised from the cleaning compartment. Solvent A drips from the basket and object into the cleaning compartment. Being a non-volatile solvent, solvent A does not evaporate from the object very quickly. However, the rinsing step will remove any residual solvent A from the object.

When lift basket 154 reaches its top-most position, the operator opens access door 166 and moves the object from lift basket 154 to lift basket 156. The operator then closes the door and initiates a rinsing cycle. Of course, transfer of the object from one lift basket to another could be automated. Lift basket 156 lowers the object, along rail 152, until the object is immersed in solvent B. Subsequent to immersion, ultrasonic array 140 is powered and ultrasonic cavitation facilitates removal of any residual particulate matter, grease, or oils as well as residual solvent A. All grease, oil or solvent A that is removed from the object cascades over first wall portion 136 into the cleaning compartment. All particulate matter that is denser than solvent B is removed from the rinsing compartment by filtration module 184. Thus, the rinsing solvent is maintained substantially contaminant free.

After a pre-defined duration, power to ultrasonic array 140 is discontinued and lift basket 156 is returned to its top-most position. Since solvent B is a volatile solvent, the solvent evaporates from the object during ascent of the lift basket. Consequently, when the user opens access door 166, the object is completely dry and ready for use.

Figure 3:
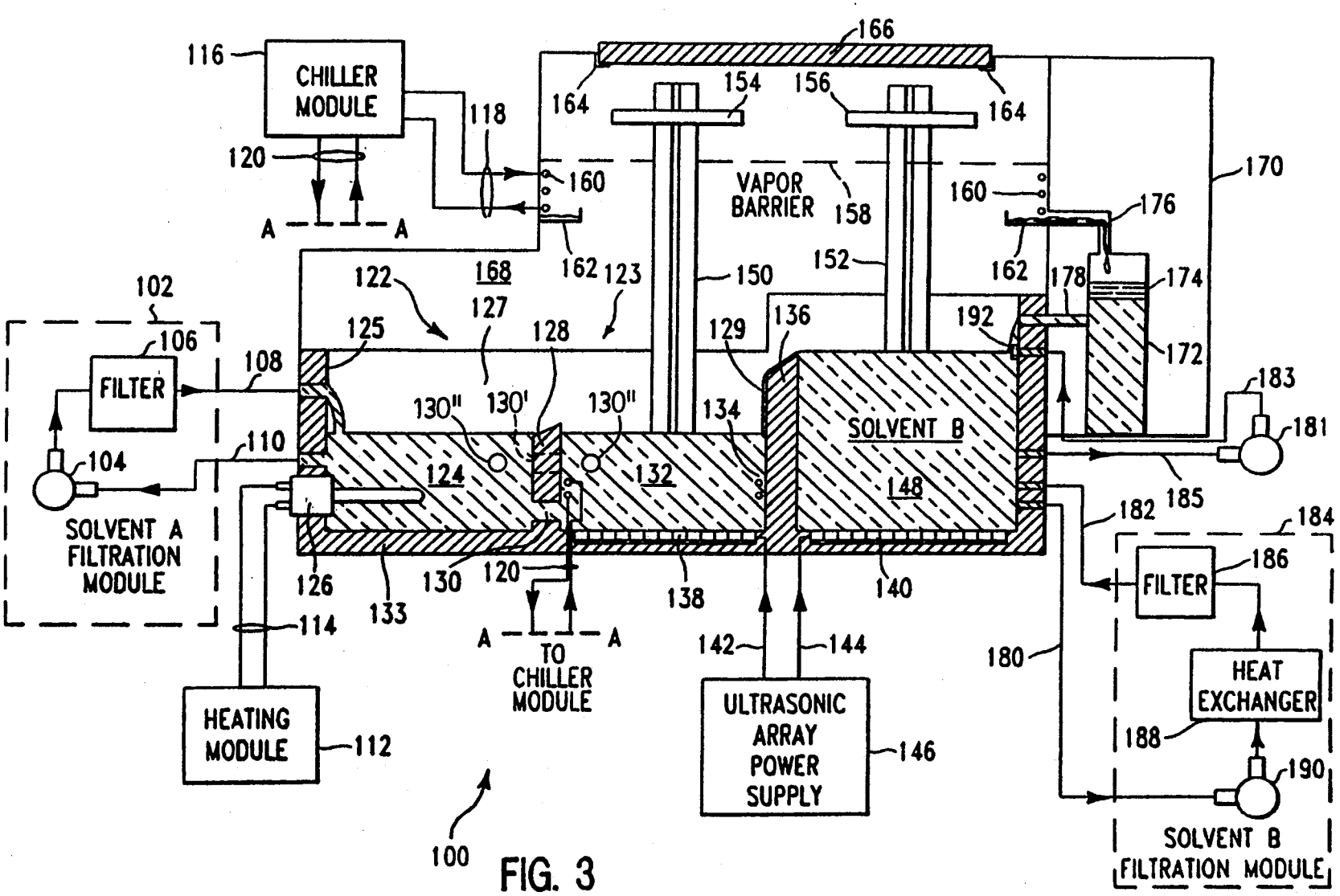
FIG. 3 depicts an alternative embodiment of our inventive cleaning apparatus during mono-solvent operation.

Alternatively, shown in FIG. 3, is a second embodiment of the cleaning apparatus. In this embodiment, the apparatus is configured for mono-solvent operation. In this configuration, solvent B is used as both a cleaning and rinsing solvent and solvent A is not used at all. Operation of the apparatus is substantially similar to that discussed above. The only difference being that, during the cleaning step, the object is immersed in solvent B within cleaning compartment 132 rather than solvent A. The fluid level of solvent B is shown as being below the height of second wall portion 128. However, the fluid level can exceed the height of the second wall portion without any detriment to the operation of the cleaning apparatus.

Although various embodiments which incorporate the teachings of the present invention have been shown and described in detail herein, those skilled in the art can readily devise many other varied embodiments that still incorporate these teachings.

We claim:

1. Apparatus for cleaning an object comprising:

a chamber including a rinsing compartment and a boil sump, said boil sump being partitioned from said rinsing compartment by a first wall portion, said first wall portion being adapted for communication of a solvent between said boil sump and said rinsing compartment, said boil sump being further partitioned by a second wall portion into a boiling compartment and a cleaning compartment, said second wall portion being adapted for communication of a solvent between said cleaning compartment and said boiling compartment, means operatively associated with said boiling compartment for boiling solvent to produce solvent vapor, means operatively associated with said rinsing compartment and said boil sump for condensing solvent vapor, means operatively associated with said condensing means for channeling condensed solvent into said rinsing compartment and for raising the level of solvent in said rinsing compartment to cascade over said first wall portion and into said cleaning compartment, and means for immersing and removing an object to be cleaned into and from said cleaning compartment whereby to clean such objects.

2. The apparatus according to claim 1 further including: means for immersing an object cleaned and removed from said cleaning compartment into and from said rinsing compartment whereby to rinse such cleaned objects.

3. The apparatus according to claim 1 wherein said cleaning compartment further comprises an ultrasonic array.

4. The apparatus according to claim 1 wherein said rinsing compartment further comprises an ultrasonic array.

5. The apparatus according to claim 1 further comprising filtration means, connected to said boiling compartment, for filtering said solvent.

6. The apparatus according to claim 1 further comprising filtration means, connected to said rinsing compartment, for filtering said solvent.

7. The apparatus according to 6 wherein said filtration means further comprises a heat exchanger means for maintaining the solvent contained in the rinsing compartment at a temperature below the boiling point of the solvent.

8. The apparatus according to claim 1 wherein said channeling means further comprises water separator means for separating water from the condensed solvent.

9. The apparatus according to claim 1 wherein said cleaning compartment further comprises means for cooling said solvent below the boiling point thereof.

10. Apparatus for cleaning an object comprising:

a chamber including a rinsing compartment and a boil sump, said boil sump being partitioned from said rinsing compartment by a first wall portion, said first wall portion being adapted for communication of a solvent between said boil sump and said rinsing compartment, said boil sump being further partitioned by a second wall portion into a boiling compartment and a cleaning compartment, said second wall portion being adapted for communication of a solvent between said cleaning compartment and said boiling compartment, means operatively associated with said boiling compartment for boiling solvent to produce solvent vapor, means operatively associated with said rinsing compartment and said boil sump for condensing solvent vapor, means operatively associated with said condensing means for channeling condensed solvent into said rinsing compartment, means connecting said rinsing compartment to said boil sump for enabling solvent to flow from said rinsing compartment into said boil sump, and means for immersing and removing an object to be cleaned into and from said cleaning compartment whereby to clean such objects.

11. The apparatus according to claim 10 further including: means for immersing an object cleaned and removed from said cleaning compartment into and from said rinsing compartment whereby to rinse such cleaned objects.

12. The apparatus according to 10 wherein said cleaning compartment further comprises an ultrasonic array.

13. The apparatus according to 10 wherein said rinsing compartment further comprises an ultrasonic array.

14. The apparatus according to claim 10 further comprising filtration means, connected to said boiling compartment, for filtering said solvent.

15. The apparatus according to claim 10 further comprising filtration means, connected to said rinsing compartment, for filtering said solvent.

16. The apparatus according to claim 15 wherein said filtration means further comprises a heat exchanger means for maintaining the solvent contained in the rinsing compartment at a temperature below the boiling point of the solvent.

17. The apparatus according to claim 10 wherein said channeling means further comprises water separator means for separating water from the condensed solvent.

18. The apparatus according to 10 wherein said cleaning compartment further comprises means for cooling said solvent below the boiling point thereof.

19. Apparatus for cleaning an object comprising:

a chamber including a rinsing compartment and a boil sump, said boil sump having four side walls and a bottom and being partitioned from said rinsing compartment by a first wall portion, said first wall portion being adapted for communication of a solvent between said boil sump and said rinsing compartment, said boil sump adapted to receive a first solvent of a first density and a second solvent of a second density which second density is greater than said first density, said boil sump being further partitioned by a second wall portion into a boiling compartment and a cleaning compartment, means interconnecting said boiling compartment and said cleaning compartment for enabling solvents to flow between said boiling compartment and said cleaning compartment, means operatively associated with said boiling compartment for boiling solvent to produce solvent vapor, means operatively associated with said rinsing compartment and said boil sump for condensing solvent vapor, means operatively associated with said condensing means for channeling condensed solvent into said rinsing compartment and for raising the level of solvent in said rinsing compartment to cascade over said first wall portion and into said cleaning compartment, and means for immersing and removing an object to be cleaned into and from said cleaning compartment whereby to clean such objects.

20. The apparatus according to claim 19 further including:

means for immersing an object cleaned and removed from said cleaning compartment into and from said rinsing compartment whereby to rinse such cleaned objects.

21. The apparatus according to claim 19 wherein said cleaning compartment further comprises an ultrasonic array.

22. The apparatus according to claim 19 wherein said rinsing compartment further comprises an ultrasonic array.

23. The apparatus according to 19 further comprising filtration means, connected to said boil sump, for filtering said first solvent.

24. The apparatus according to 19 further comprising filtration means, connected to said rinsing compartment, for filtering said second solvent.

25. The apparatus according to 24 wherein said filtration means further comprises a heat exchanger means for maintaining the second solvent contained in the rinsing compartment at a temperature below the boiling point of the second solvent.

26. The apparatus according to 19 wherein said channeling means further comprises water separator means for separating water from the condensed second solvent.

27. The apparatus according to 19 further comprising means, located between said boiling and cleaning compartments, for enabling said first solvent to flow between said boiling and cleaning compartments.

28. The apparatus according to claim 27 wherein said means for enabling said first solvent to flow between said boiling and cleaning compartments further comprises a second conduit between said boiling and cleaning compartment that enables only said first solvent to flow between said boiling and cleaning compartments.

* * * * *